United States Patent [19]

Bellia

[11] 4,352,491

[45] Oct. 5, 1982

[54] EXERCISE TABLE

[76] Inventor: Ferdinando Bellia, 51 Regina Rd., Monsey, N.Y. 10952

[21] Appl. No.: 159,009

[22] Filed: Jun. 13, 1980

[51] Int. Cl.[3] ..... A63B 23/00

[52] U.S. Cl. ..... 272/144; 128/25 R

[58] Field of Search ..... 272/144, 145; 128/25 R, 128/33, 60, 61, 63, 64, 70–75

[56] References Cited

U.S. PATENT DOCUMENTS

| | | | |
|---|---|---|---|
| 2,385,998 | 10/1945 | Martin | 128/72 |
| 2,886,028 | 5/1959 | Vogtmann et al. | 128/25 R |
| 3,019,786 | 2/1962 | Krauss | 128/33 |
| 3,881,469 | 5/1975 | Kanemitsu | 128/25 R |
| 4,210,134 | 7/1980 | Okazaki et al. | 128/60 X |

*Primary Examiner*—Richard J. Apley
*Attorney, Agent, or Firm*—Louis A. Tirelli

[57] ABSTRACT

An exercise table having a flat semi-rigid support with a rigid cushion support alignment means at one end which acts to align the spine of a person lying on the exercise table and a pair of spaced apart alignment tubes extending longitudinally from the same end of the flat semi-rigid support for providing alignment of the head with the portion of the spine craddled within the rigid cushion support alignment means. As the person performs rocking exercises on the exercise table and continually slides his head and body further along the rigid cushion support alignment means and pair of alignment tubes, a support means is disposed to rotatably support the flat semi-rigid support on the floor.

12 Claims, 6 Drawing Figures

FIG.6
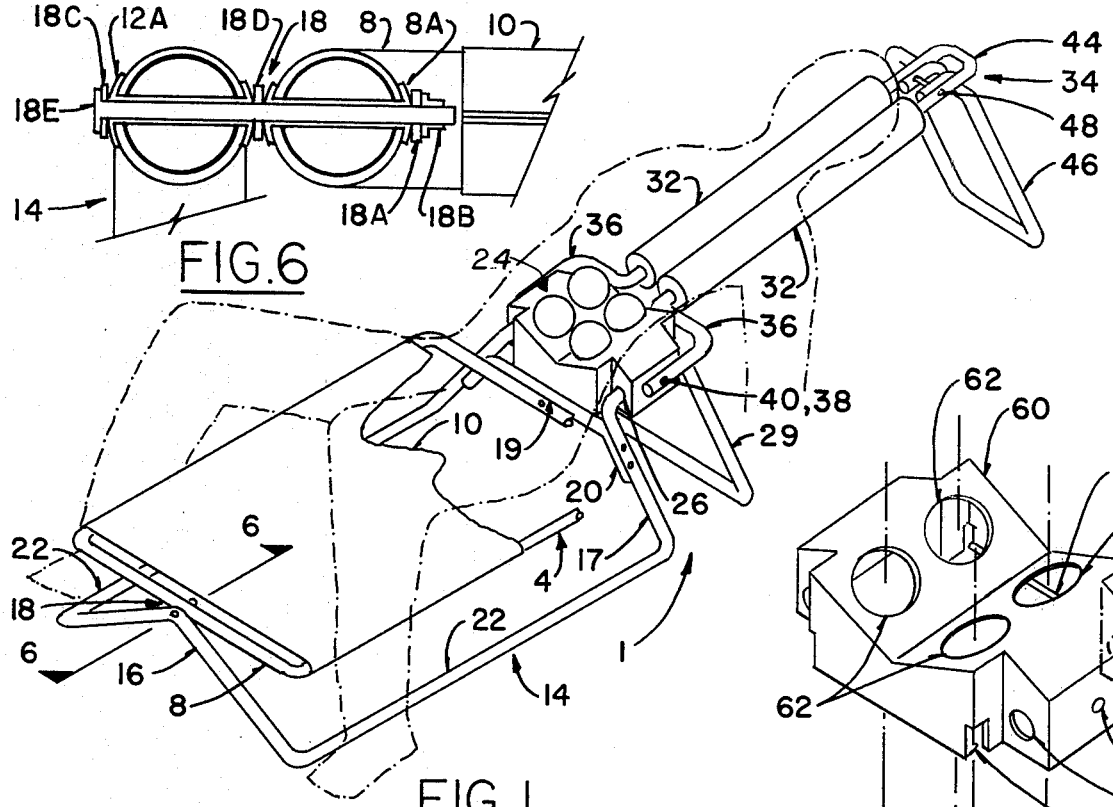
FIG.1
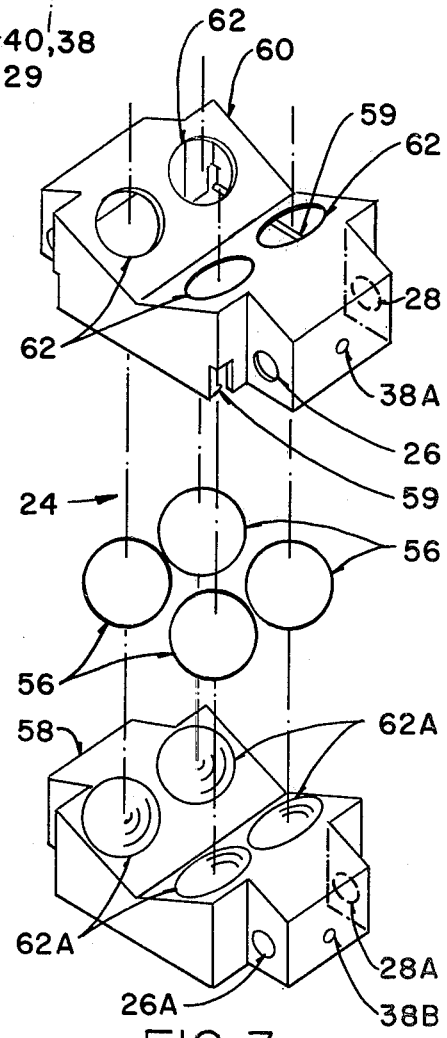
FIG.3
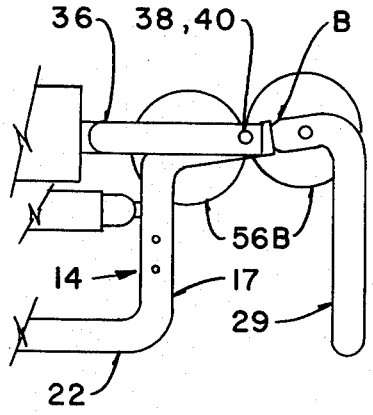
FIG.4
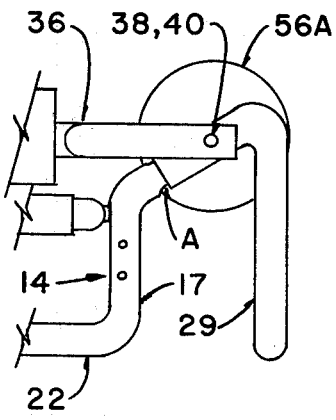
FIG.5
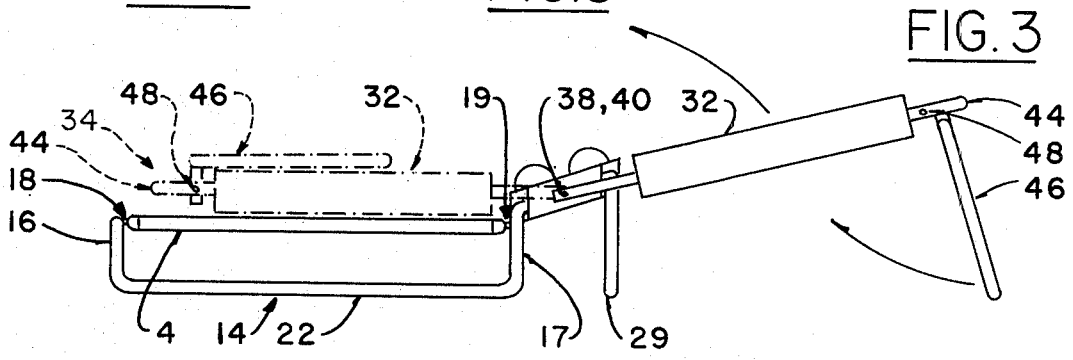
FIG.2

EXERCISE TABLE

BACKGROUND OF THE INVENTION

This invention relates to an exercise table and more particularly to an exercise table which permits exercise while aligning succeeding portions of the spine in an aligned position. Furthermore the exercise table described herein is foldable to reduce the necessary storage space when the exercise table is not being used.

There are many exercise tables in use which are foldable and are intended for use on the neck and back. Many of these exercise tables are intended for use by a person lying on his back. Furthermore, these exercise tables have head rests and some even have rollers and/or wheels which move along the back to stimulate the back of the person using the exercise table. However none of these exercise tables are equipped with means to allow the person using the exercise table to perform their exercise and at the same time align portions of the spine and also maintain alignment in the spine.

For example U.S. Pat. No. 1,539,214 (Shockey) describes a flat table for exercise which is foldable for use as a settee when being stored. Shockey also has spring arms to provide tension against a person using the table when rotating thereon. But Shockey lacks any alignment means for the spine of the person using the table.

Another example of an exercise table is U.S. Pat. No. 3,561,022 (James) which describes a health slant board which pivots on the apex of a triangular base. James' table is only intended to provide a person using the table to bring his feet higher than his head.

An example of a rocking device is U.S. Pat. No. 2,417,618 (Scott) which is a toy rocker. Scott is not intended for use with a supine person and is not provided with any spine alignment means or support.

Examples of sophisticated exercise tables are U.S. Pat. Nos. 1,626,065 (Rosenquist) and 3,881,469 (Kanemitsu). The former is a chiropractic table which provides rollers to move along the back of a supine person using this table. Rosenquist also provides elevation of different ones of the rollers by the person activating same with his feet. However, Rosenquist does not provide any spine alignment means for the person using the table. Likewise in the latter exercise table there are provided numerous wheel like supports which are spaced along the length of a two-portion table. The two portions of the table each move in a circular motion to exercise the waist muscles by the adjacent ends of the two portions being raised and lowered continuously by a motor driven rod. The wheel like supports are used to provide a massaging effect along the entire body by the rollers making contact along the back of the person using the table. No where does Rosenquist describe a table provided for a person lying thereon to rock back and forth and to move longitudinally head first along alignment devices which simultaneously straighten and maintain straightness of the spine of the person using the table.

In another example of a device of the present art there is provided in U.S. Pat. No. 1,904,039 (Bruder) a preformed pad with no provisions for alignment of the spine of the user.

Lastly, in two examples of devices of the present art U.S. Pat. Nos. 1,721,709 (Odell) and 2,475,289 (MacGregor), there are provided a support table with gripping means. The latter additionally includes longitudinal rocking means. But nowhere do either of these disclosures describe spine alignment means or means for maintaining the spine alignment.

What is desired is an exercise table which provides support for a person using same in a lateral rocking manner and providing spine alignment means and means for maintaining the spine in an aligned manner while so rocking the exercise table.

The present application solves this problem in a novel and heretofore unobvious manner which will be described below.

BRIEF SUMMARY OF THE INVENTION

In accordance therewith, the present invention provides an exercise table having a flat semi-rigid support and a rigid cushion fixedly attached to one end of the flat semi-rigid support. Also included are rigid cushion support alignment means which are supported in place on either side of the rigid cushion support alignment means and spaced apart from each other and arranged to maintain the spine in the neck and back of a person lying on the flat semi-rigid support in a straight line while using the exercise table. The alignment means are further enhanced by a pair of alignment tubes which extend longitudinally from the end of the flat semi-rigid support having the cushion attached thereto. The pair of alignment tubes are spaced apart laterally from each other and are in line with the rigid cushion support alignment means. Support means are rotatably affixed to each end of the flat semi-rigid support for supporting the exercise table on the floor and allowing the flat semi-rigid support to rock laterally in use by the person lying on the flat semi-rigid support. Wherefore the exercise table provides a person using the same with a means of relieving tension and strengthening the back and neck muscles.

In another aspect of the present invention, the flat semi-rigid support is a rectangular tubular frame with a cloth material tightly stretched on either side along the longitudinal tubes of the rectangular tubular frame.

In a further aspect of the present invention, the cloth material is canvas.

In a still further aspect of the present invention the rigid cushion is a stiff plastic.

In another aspect of the present invention, the rigid cushion is fabricated from wood.

In a still further aspect of the present invention, the alignment means are for longitudinally and laterally spaced apart resilient spheres.

In a still further aspect of the present invention, the resilient spheres are balls.

In a further aspect of the present invention, the support means are a continuous frame having the shape of an inverted "V" at the end opposite the rigid cushion support alignment means and a truncated "V" at the opposite end. Also included are two laterally spaced apart floor members which lie flat on the floor and which floor members are joined at either end to one leg of each of the full and truncated inverted "V's". The apex and cross arm member of the full and truncated inverted "V's", respectively are rotatably connected to either longitudinal end of the flat semi-rigid support and the semi-rigid support is rotatably supported on the floor members.

In another further aspect of the present invention, the pair of alignment tubes are positionally and rotatably connected to the rigid cushion and the pair of alignment tubes are foldable onto the flat semi-rigid support for ease in transportation.

In another aspect of the present invention, the pair of alignment tubes include a rigid and a foldable leg to support the alignment tubes when being used by the person using said exercise table.

Having briefly described the broad aspect of the present invention, it is a principal object thereof to completely eliminate the problems above referred to and therefore achieve an exercise table which is unique and which is foldable to a compact package while being usable to perform rocking exercises on the lower portion of the body while aligning and maintaining the alignment of the spine of the person using the exercise table.

An object of the present invention is to provide an exercise table which is particularly adapted for use in supporting a person lying supine with face up on the exercise table and permitting the person thereon to rock laterally.

Another object of the present invention is to provide an exercise table which includes alignment means for aligning the spine of a person using the exercise table.

A further object of the present invention is to provide an exercise table which includes further alignment maintaining means to maintain the alignment of the spine of a person using the exercise table.

An advantage to the herein described exercise table is the ease of fabrication thereof.

Another advantage resulting from the present invention is that it can be folded into a compact package.

A still further advantage of the present invention is an exercise table which can be used to rock the lower portion of the body and thereby relax the back muscles and maintain the alignment of the spine of the person using the table.

Many additional objects and advantages accrue from the invention, as those skilled in the art will appreciate as the invention is more fully described hereinafter.

BRIEF DESCRIPTION OF THE DRAWING

The present invention will be more readily apparent from an understanding of the following detailed description of the embodiment of the present invention when considered in conjunction with the accompanying drawings in which:

FIG. 1 is a perspective view of an exercise table in an open position which is the usable condition, constructed in accordance with the invention and with a dashed outline of a person using the same detailed thereon.

FIG. 2 is a side elevational view of an exercise table showing a similar embodiment as that of FIG. 1 and showing in dashed outline the pair of alignment tubes and foldable support leg folded over the flat semi-rigid support when the embodiment of the present invention is to be stowed.

FIG. 3 is an exploded view of the rigid cushion support alignment means of the embodiment of FIGS. 1 and 2 and showing four spaced apart resilient spheres.

FIG. 4 is a side elevation view of the alternative embodiment of FIGS. 1, 2, and 3 having four wheels, two on one side only being shown of the rigid support alignment means.

FIG. 5 is a side elevation view of an alternative embodiment of FIGS. 1 thru 4 having two wheels, one side only being used of the rigid support alignment means.

And, FIG. 6 is a section of the pivot of the flat semi-rigid support of the exercise table of the embodiment of FIG. 1, showing the construction of the pivot in accordance with the invention.

DESCRIPTION OF THE PREFERRED EMBODIMENT

It is noted in the drawing that similar parts of like members are given similar reference numerals and alternate embodiments are given a letter following the similar reference numeral. Referring to FIGS. 1 and 2 there is shown an embodiment of the invention which is generally indicated at 1 and referred to as an exercise table. The exercise table includes a flat semi-rigid support 4. The flat semi-rigid support 4 can be fabricated from tubing (unnumbered) which is joined together on four sides to form a rectangular tubular frame 8. The tubing (unnumbered) of the rectangular tubing frame 8 is interconnected in a known manner, that is one end of the tubing (unnumbered) is squeezed smaller and fitted within another end interconnecting the two ends of the tubing (unnumbered) thereby. (See for example FIG. 5 at A).

A resilient material 10 such as cloth, canvas or other known materials is stretched laterally across the rectangular tubular frame 8 in a known manner.

Tubing (unnumbered) can be manufactured from pipe, or round, square or any other cross-sectional tubing conventionally obtainable.

A support means is generally described at 14 and can be fabricated from tubing or other similar commercial material such as pipe and other structural members. The support means 14 is also called a support frame 14. The support frame 14 is shown in FIGS. 1, 2, 4, 5 and 6. The support frame 14 is bent to have the shape of an inverted "V" at 16 and a truncated "A" at 17. Both the inverted "V" 16 and the truncated "A" 17 being disposed at the leg and head end respectively of the flat semi-rigid support 4. The tip of the inverted "V" (unnumbered) and the center of the cross arm 20 of the truncated "A" are rotatably connected to the lateral center point of the flat semi-rigid support 4 as shown at 18 and 19, respectively, and in FIG. 6. The cross arm 20 is attached to the top of the legs (unnumbered) of the truncated "A" by bolts, rivets, or other known connecting means. (Shown but not numbered).

The support means 14 is manufactured from pipe or round, square or any other tubular commercial material. The support means 14 is bent at approximately a 120° angle at the connection point 18 although other angles are equally workable as can be seen from the embodiment shown in FIG. 1. A line drawn through the rotatable connecting points of the flat semi-rigid support 4 is substantially parallel to the ground. The rotatable connection is shown at 18 and 19 in FIGS. 1, and 2 and the former is also shown in FIG. 6. The latter is manufactured in one embodiment as a fixed rod 18E which fits through metal or plastic sleeves 12A and 8A in the support means 14 and rectangular tubular frame 8, respectively, and is held in position by a washer and locking nut 18A and 18B, respectively. Two additional washers 18C and 18D are provided at the friction points as shown in FIG. 6. Of course, the rotatable connection can be a simple rivet or any other well known means of connecting two parts together rotatably. Similarly, the preferred rotatable connection between the flat semi-rigid support 4 and the cross arm 20 is that shown in FIG. 6. Again, the flat semi rigid support 4 and the cross arm 20 can be rotatably connected by means such as a rivet, screw or other known means.

The support frame 14 includes floor members 22 which extend flat along the floor and join the bottom of the inverted "V" 16 on each side to the bottom of the truncated "A" 17. This floor member 22 can be continuous with the inverted "V" 16 and truncated "A" 17 or joined as desired and economically practical.

The inverted "V" 16, and truncated "A" 17 and floor members 22 thereby form one continuous support frame 14. The connecting ends of the floor members 22 and the inverted "V" 16 and truncated "A" 17 can be welded together or prevented from separating by putting screws through the connecting joints by known means if not continuous. In this manner it can be seen that the flat semi-rigid support 4 is rotatably supported by the support frame 14 which rests on the floor (not shown).

A rigid cushion 24 is fixedly attached to the truncated "A" 17 as shown in FIGS. 1 and 2 by the tubing or other commercial material of the top of the legs of the truncated "A" 17 being fitted and secured within opening 26 on either side of the rigid cushion 24 as will be described below. The rigid cushion 24 is also provided with openings 28 which are on the side opposite openings 26 and spaced apart from each other. A substantially triangular support leg 29 depends from the openings 28 and supports the rigid cushion 24. The support leg 29 is manufactured from pipe tubing or other commonly available material and the ends (unnumbered but shown) of the support legs 29 at the top fit into the openings 28 so that the portions of the support leg 29 and truncated "A" 17 fitting into the rigid cushion 24 are inserted into each other on either side of the truncated "A" 17 similar to B in FIG. 4.

A pair of soft alignment sleeves 32 are provided and positionally spaced from the rigid cushion 24 by being fitted over tubing 34 which is shaped in the form of a U with laterally extended tines 36. The tines 36 are formed by the tubing 34 being bent 90° away from each other and 90° back into the same original direction. A bolt 40 passes through connecting openings 38 which are provided in tines 36 and opening 38A and 38B in the rigid cushion 24. These are only shown on one side in FIGS. 1 thru 5 of the drawing but are provided on both sides. The bolt 40 also passes through openings (unnumbered and not shown) in the tubing of the top of the legs of the truncated "A" 17 and support leg 29 then through the same parts in the opposite order on the other side of the support leg 29, tubing of the top of the legs of the truncated "A" 17, openings 38B and 38A of the rigid cushion 24 and opening 38 in the tines 36. The bolt 40 thereby prevents the tubing or other material of the truncated "A" 17 support leg 29 and the tines 36 from being dislodged from the rigid cushion 24.

In this manner of connection, the tubing 34 with the pair of alignment sleeves 32 is pivotable on the bolt 40 so that the tubing 34 can be folded over and on top of the semi-rigid support 4 when the exercise table 1 is not in use. This is shown in dotted in FIG. 2. In a preferred embodiment, a soft resilient material such as plastic or rubber is wrapped around or slid onto tubing 34 to form the pair of alignment sleeves 32. The soft resilient material extends from before the tine to a short distance before the base of the "U" shown at 44. This acts as a restful cushion on the back and head of the person using the exercise table as the person moves his way up the pair of alignment sleeves 32 while in use.

In order to maintain the pair of alignment sleeves 32 in position for supporting the person using the exercise table 1, support legs 46 are provided. The support legs 46 can be of any known form and are constructed of pipe or tubing which are commercially available. In the preferred embodiment of the invention, the support legs 46 are bent in a rectangular fashion as shown in FIGS. 1, and 2 and the ends (unnumbered) are fitted between the portion of "U" 44 and are held in place in use by the tubing 34 being supported at an angle and the support legs 46 being open. In this fashion the shoulders (unnumbered) of the support leg 46 are locked against the portion of the "U" 44 and thereby held in place. A bolt 48 passes through the end of the "U" 44 and the ends of the support leg 46 upon which the support leg 46 is rotatable to fold the support leg 46 against the pair of alignment tubes 32 when not in use. See FIG. 2.

Rigid cushion support means 56 are provided on the rigid cushion 24 and are shown in FIGS. 1, 2 and especially in 3. The rigid cushion 24 in a preferred embodiment is manufactured in two parts, a support 58 and a retainer cover 60 both of which can be manufactured of plastic by injection molding process or other known means. The top of the retainer cover 60 forms an angle of from 90° to 180°. Openings 26 and 28 are provided on each end and openings 38A are provided at opposite side ends. The top of the retainer cover 60 is provided with four separate circular openings 62. The diameter of these openings are slightly less than the diameter of four resilient spheres which comprise the rigid cushion support means 56. The resilient spheres making up the rigid cushion support means 56 in practice can be simple tennis balls with or without fabric thereon. The circular openings 62 are spaced apart sufficiently so that the neck and spine of a person can lie along the angle of the retainer cover on the rigid cushion support means 56. In use, the sides of the resilient spheres of the rigid cushion support means 56 make contact with both sides of the neck and spine but not so close as to make it uncomfortable for the person using the machine.

The retainer cover 60 is fitted over the support 58 which has matching openings 26A and 28A and openings 38B on either side. Also provided in support 58 are four hemispherical cups 62A for supporting the rigid cushion support means 56. The retainer cover 60 when in place fits over the support 58 with the resilient spheres of the rigid cushion support means 56 sandwiched in place therebetween, the latter being secured between the support 58 and retainer cover 60 by the diameters of the circular openings 62 being smaller than the diameter of the rigid cushion support means 56. Lips 59 are provided on opposite inside walls of the retainer cover 60 to lock the retainer cover 60 onto support 58 when snapped thereover in known member. FIG. 3 best depicts the rigid cushion 24 assembly sequence.

In FIG. 2 there is shown the tubing 34 and support legs 46 (shown dotted) folded over the flat semi-rigid support 4 for storage of the exercise table 1. The support frame 14 supports the stored exercise table 1.

In varying embodiments of the alignment means 56, the following may be substituted and are also desired embodiments. Two resilient wheels 56A (FIG. 5) which are spaced laterally to support the spine in the neck and back of a person using exercise table 1.

In a further embodiment of the invention, four resilient wheels 56B are shown in FIG. 4 with two in line and two spaced apart resilient wheels 56B. It is to be noted that FIGS. 4 and 5 only show the resilient wheels 56B and 56A, respectively on one side of the exercise table 1 and show the tubing 34 folded over. The support legs 29 are higher and modified to replace the rigid cushion 24.

It can be understood from the description above, the exercise table when used is unfolded from the dotted position of FIG. 2 to the solid position as shown in FIG. 2 and the support legs 46 are unfolded to a locking position as shown so that the pair of alignment sleeves and tubing 32 and 34, respectively are at an angle as shown in FIGS. 1 and 2.

The person using the execise table 1 initially sits down upon the flat semi-rigid support 4 so that his legs are extending over the edge thereof, while his neck is cradled between the resilient spheres or wheels of the rigid cushion support means 56, 56A and 56B in the embodiments of FIGS. 1, 4 and 5, respectively. The person using the machine then rocks the flat semi-rigid support 4 laterally up and down in a see-saw motion and the flat semi-rigid support 4 pivots about the connection of support at 18 and fixed rod 19. This action places one side of his buttocks lowe than the other and then reverses this position. Meanwhile, the neck of the person using the exercise table 1 is cradled and resting on the rigid cushion 24. During this motion the resilient spheres (or wheels 56a or 56B) which make up the rigid cushion support means 56 straighten the spine of the person using the exercise table 1 at the neck area.

There is also provided a tingling effect against the various acupressure points on the neck and back as the resilient spheres or wheels 56, 56A and 56B, respectively make contact therewith. This acts to relax the neck and back muscles.

The person using the exercise table 1 then moves his body up forward along the tubing 34 so that his neck is cradled in the soft resilient material 42 of the pair of alignment sleeves 32 while the spine of his upper back rests on the rigid cushion 24, the spine being between the spaced apart resilient spheres or wheels 56, 56A and 56B respectively, and the same exercise of rotation on the flat semi-rigid support 4 is performed again by the person. During this next exercise the portion of the spine located in the neck that has already been aligned, is maintained in this alignment by the pair of spaced alignment sleeves 32.

The person using the exercise table 1 continually moves his body until his lower lumbar region finally fits on the resilient sphere or wheels 56, 56A and 56B respectively and his spine in both the neck and back all rest on the pair of alignment sleeves 32. Also, his feet are supported on the flat semi-rigid support 4.

As can be understood, the person using the exercise table 1 may also begin using the exercise table by placing his lower lumbar region (not shown) on the rigid cushion 24 and his upper back, neck, and head on the pair of alignment sleeves 32 and moving in the opposite direction by ending with his neck on the rigid cushion 24.

It should be noted that not only do the resilient spheres and wheels 56, 56A and 56B respectively act to align the spine in the neck and back of the person using the exercise table 1, but furthermore the acupressure points along the spine in the neck and back of the person are contacted and tension therein is relieved.

As may be seen, many and various embodiments of the exercise table 1 all are within the purvue of the instant disclosure. Furthermore, the resilient spheres 56 which are held in the rigid cushion 24 may be replaced by tubular wheels 56a and 56b as shown and understood from FIGS. 4 and 5.

Also, as can be seen the pair of alignment sleeves 32 slope upward from the flat semi-rigid support 4 in a preferred embodiment with the support legs 46 higher than the flat semi-rigid support 4.

This in no way limits the invention of the embodiments of the other figures. Thus, the instant disclosure has included many variations and embodiments for purposes of breath since many further changes could be made in the embodiment of the invention as particularly shown and described herein without departing from the scope of the invention. Thus, it is intended that the disclosed embodiments be considered as exemplary and that the invention not be limited except as warranted by the following claims.

What is claimed is:

1. An exercise table comprising:

a. support means;

b. a flat semi-rigid support which is rotatably affixed at each end to said support means, the latter of which supports said exercise table on the floor and said flat semi-rigid support being disposed to rock laterally on said support means when in use by a person;

c. a rigid cushion fixedly attached to one end of said support means and extending outwardly therefrom;

d. a plurality of rigid cushion support means affixed in said rigid cushion with a portion of said rigid cushion support means exposed for cradling the spine in the neck and back of a person on said flat semi-rigid support; and e. tubing extending from said rigid cushion and pivotably secured to said rigid cushion at an extension of said tubing so as to be foldable onto said flat semi-rigid support, said tubing having a pair of spaced apart soft alignment sleeves secured on said tubing;

said exercise table provides a person using the same with a means of relieving tension by relaxing the back and neck muscles while relaxing any spinal misalignments developed from tension, poor posture or muscle strain.

2. An exercise table as claimed in claim 1, wherein said flat semi-rigid support is a rectangular tubular frame with a cloth material tightly stretched and secured on either side along the longitudinal tubes of said rectangular tubular frame.

3. An exercise table as claimed in claim 2, wherein said cloth material is canvas.

4. An exercise table as claimed in claim 1, wherein said rigid cushion is a stiff plastic.

5. An exercise table as claimed in claim 1, wherein said rigid cushion is fabricated from tubing.

6. An exercise table as claimed in claim 1, wherein said plurality of rigid cushion support means are four longitudinally and laterally spaced apart resilient spheres affixed within said rigid cushion with less than a hemisphere thereof exposed.

7. An exercise table as claimed in claim 6, wherein said four longitudinally and laterally spaced apart resilient spheres are tennis balls.

8. An exercise table as claimed in claim 1, wherein said plurality of rigid cushion support means are four longitudinally and laterally spaced apart wheels, rotatably mounted for lengthwise rotation.

9. An exercise table as claimed in claim 1, wherein said plurality of rigid cushion support means are two longitudinally and laterally spaced apart wheels, rotatably mounted for lengthwise rotation.

10. An exercise table as claimed in claim 1, which further includes a support leg for support of said rigid cushion.

11. An exercise table as claimed in claim 1, wherein said tubing includes foldable support legs opposite said extension to support said tubing when being used by the person using said exercise table.

12. An exercise table as claimed in claim 1, wherein said support means is a continuous frame having the shape of an inverted "V", disposed at one end and a truncated "A" disposed at the other longitudinal end.

* * * * *